United States Patent [19]

McLain

[11] 4,309,924

[45] Jan. 12, 1982

[54] NUT AND RETAINER FOR QUICK ADJUSTABLE JAW WRENCH

[75] Inventor: Donald E. McLain, Portage, Mich.

[73] Assignee: Kalamazoo Incorporated Technology, Kalamazoo, Mich.

[21] Appl. No.: 57,389

[22] Filed: Jul. 13, 1979

[51] Int. Cl.[3] ..... B25B 13/16

[52] U.S. Cl. ..... 81/159

[58] Field of Search ..... 81/165–169, 81/159, 160, DIG. 3, 100, 101

[56] References Cited

U.S. PATENT DOCUMENTS

| | | | |
|---|---|---|---|
| 1,367,407 | 2/1921 | McClurkin | 81/167 X |
| 1,588,105 | 6/1926 | Hanford | 81/165 |
| 1,778,748 | 10/1930 | Bayrer | 81/101 |
| 1,990,137 | 2/1935 | Schrubb | 81/160 |
| 2,483,917 | 10/1949 | Maselter | 81/165 |
| 3,200,677 | 8/1965 | Miranda | 81/160 |

*Primary Examiner*—James G. Smith

*Attorney, Agent, or Firm*—Blanchard, Flynn, Thiel, Boutell & Tanis

[57] ABSTRACT

A wrench having an adjustable jaw on a neck slidably supported by a guide on a handle with segmental threads on at least one side of the neck. An adjusting nut is threaded on the neck and has segmental threads rotatably and drivingly engagable with the threads on the neck. The threads on the neck are axially slidable between the ends of the segmental threads on the nut in at least one rotated position of the nut. A U-shaped spring has spaced arms which springably engage the opposite axial faces of the nut to confine the nut therebetween. The spring has a connecting bight which is nonrotatably opposed to wrench handle. The arms of the spring defining openings through which slidably and nonrotatably pass the neck.

9 Claims, 5 Drawing Figures

NUT AND RETAINER FOR QUICK ADJUSTABLE JAW WRENCH

This invention relates to improvements in the type of wrench in which a fixed jaw is carried on the end of a lever-like handle and the opposed movable jaw is L-shaped, with a flat sided neck extending through a noncircular guide formed on the handle adjacent the fixed jaw. An adjusting nut having internal threads is rotatable about segmental thrrads on the edges of the neck while being retained axially between the rear side of the guide and a stop projecting from the handle. It has been proposed to render such wrenches adjustable by either threading action of the nut on the threads of the neck or by unrestricted sliding motion of the neck through interruptions of the internal thread on the nut. A good example of such prior adjustable wrenches is shown in the patent to Jeffres, U.S. Pat. No. 2,065,276.

The novel feature of the invention is the provision of a clip-nut assembly which can be mounted on most conventional pipe wrenches for converting same into quick-acting slidably-adjustable jaw wrenches.

Further novel features of the wrench of this invention are the provision of angularly spaced and radially extending detents on one or preferably both axial faces of the nut and nonrotatable but yieldably axially movable coacting detent means adjacent the face or faces of the nut to restrain rotation of the nut at angularly spaced intervals.

BRIEF DESCRIPTION OF DRAWINGS

The drawings, of which there is one sheet, illustrate a preferred embodiment of the invention.

DETAILED DESCRIPTION

Figure 5:
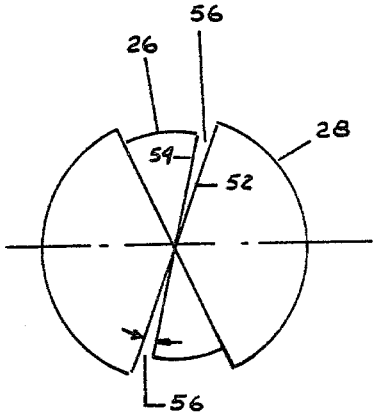
FIG. 5 is a schematic diagram showing the rotational pattern of the nut.
Figure 4:
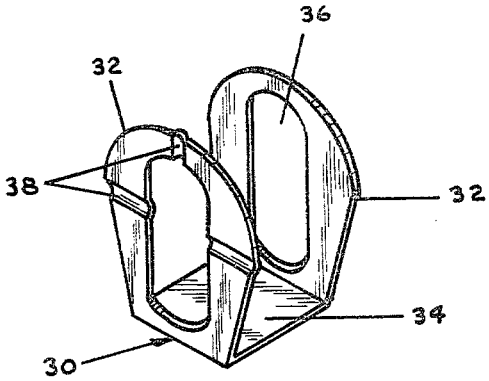
FIG. 4 is an end elevational view of the back or lower side of the retaining spring shown in FIG. 1.
Figure 3:
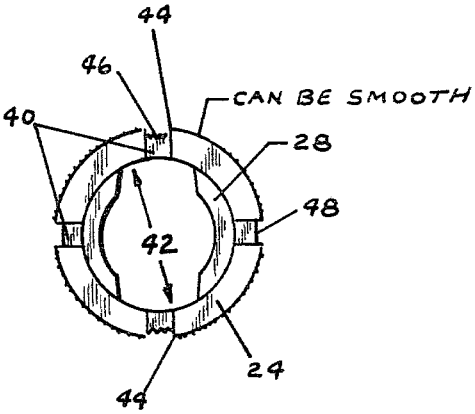
FIG. 3 is an enlarged end elevational view of the back or lower face of the nut shown in FIG. 1.
Figure 1:
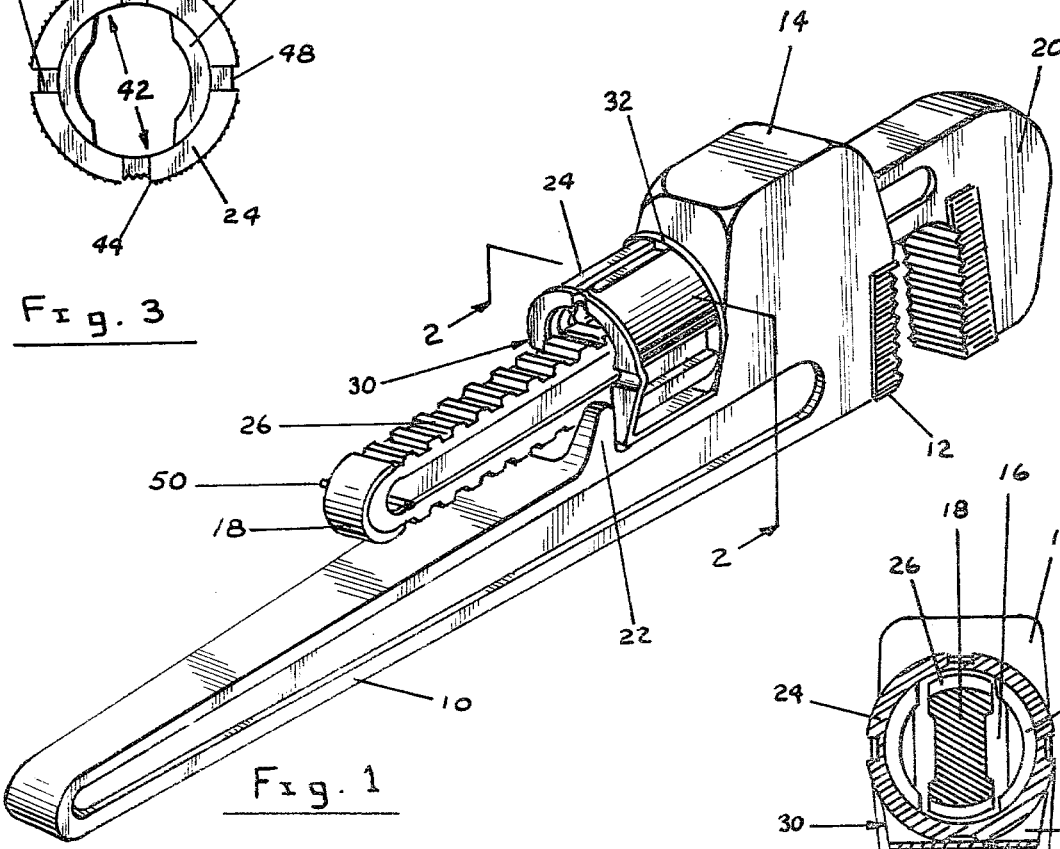
FIG. 1 is a perspective view of a preferred form of the wrench.

The wrench of the invention has most of the well known parts of existing wrenches. In fact, the novel features of the wrench can be installed in a popular commercial wrench. The handle 10 has a fixed jaw 12 on its outer end, and a laterally projecting slide housing 14 with a noncircular guide opening 16 therethrough. The opening slidably receives the rectangular neck 18 of the adjustable jaw 20 which projects laterally in opposed relation to the fixed jaw 12. Stops 22 on the handle limit axial motion of a nut 24 on the neck 18. The neck is rectangular in cross section and has segmental threads 26 on its opposite narrower faces. The threads 26 coact with segmental threads 28 on the inside of the nut.

Figure 2:
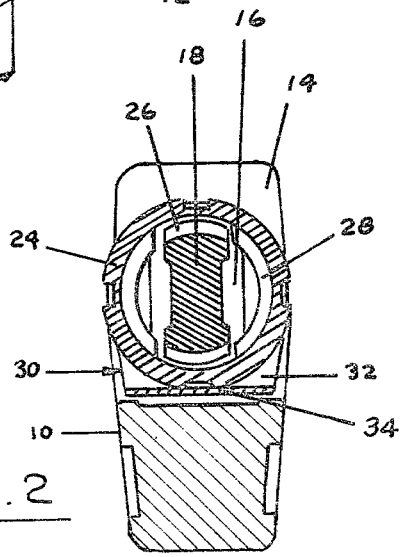
FIG. 2 is an enlarged cross sectional view through the handle, nut and neck of the jaw taken along the plane of the line 2—2 in FIG. 1, clearance between parts being exaggerated.

Coacting with the nut 24 is a U-shaped retaining clip or spring 30 having arms 32 that fit loosely between the rear of the housing 14 and the stops 22, which arms 32 springably engage the opposite axial faces of the unit. The bight 34 of the spring sometimes rests on the back of the handle 10 but, as shown in FIG. 2, is normally spaced therefrom. The arms 32 have rectangular openings 36 which pass the neck 18. One of the arms 32, in this case the rear arm, has detent ribs 38 pressed inwardly of the U-shaped section of the spring at angularly spaced 90° intervals to bear against the opposing axial face of the nut. Note that the ribs can be on the other or both of the arms 32.

The nut 24 has angularly spaced and radially extending detent grooves 40 formed in its axial face opposed to the detents 38 on the spring 30. While four grooves arranged in cruciform relation are desirable, two or even one groove arranged to engage one of the spring detents 38 when the gaps 42 in the internal teeth 28 of the nut register with the segmental teeth 26 of the neck 18 would be sufficient to effect the release of the neck from the nut for quick axial adjustment of the jaw 20. Desirably, the circumference of the nut 24 has at least one sight and touch identifiable indicia thereon to indicate when the nut is rotated to register the gaps 42 with the teeth 26 of the neck. In the form illustrated, diametrically opposed grooves 44 having identifiable serrated surfaces 46 while grooves 48 have smooth surfaces. Color may also be used to distinguish the grooves.

Since nut 24 is resiliently confined by arms 32 of clip 30, which clip is loosely confined between housing 14 and stops 22, the clip and nut can hence move with the shank as the latter pivots during usage of the wrench.

A stop pin 50 projects from the sides of the rear end of the neck to coact with the stops 22 and prevent the neck from sliding completely through the slide housing 14 and accidentally dropping the adjustable jaw when the nut is arranged in clearing relation to the teeth on the neck.

FIG. 5 illustrates achematically the action of the wrench and its releasable nut. If the diametrical line 52 connects opposite ends of opposite teeth 28 on the nut, and line 54 connects the opposed ends of segmental teeth 26 on the neck, it will be seen that except for a small clearance gap 56, that the two sets of threads will engage and be effective to adjust the neck 18 and the spacing of the jaws 12 and 20 through rotation of the nut through slightly less than 180° in either direction.

However, when the nut 24 is manually rotated into the position shown in FIG. 2 such that the gaps 42 are aligned with the jaw threads 26, in which position the nut is held by the spring detent 38, the jaw 20 can then be freely slidably displaced relative to the housing 14 to permit a rapid coarse adjustment between jaws 12 and 20.

It is pointed out that the nut 24 and the spring 30 may be sized to fit popular wrenches, and that all that is required to convert conventional wrenches is to remove existing nuts and substitute the new nut 24 and spring 30, and possibly add the safety stop pin 50. This substitution of nut 24 and spring 30 on a conventional wrench can be accomplished without requiring any structural modification of the remaining wrench structure inasmuch as the spring 30 is not fixedly secured to the wrench handle, but is retained solely due to the manner in which the spring is nonrotatably held by the jaw shank. The modified nut and new spring are therefor claimed as an invention apart from the standard wrench parts, as well as in combination with them. As has been pointed out, the number and positions of the detent ribs 38 on the spring and coacting grooves 40 and indicia lines or grooves 44 and 48 may be varied as desired without departing from the spirit of the invention.

What is claimed to be new, and what is desired to be secured by Letters Patent, is defined in the following claims:

1. In a jaw-type wrench having an elongated handle provided with an enlarged housing adjacent one end thereof, said housing having a noncircular opening extending therethrough, a fixed jaw secured to said housing, a movable jaw element having thereon a movable jaw positioned substantially opposite said fixed jaw, said movable jaw element having an elongated shank which slidably extends through the opening in said housing, said shank being of noncircular cross section and having segmental threads formed along at least one side thereof, said handle also having an open region defined between a pair of opposed stop surfaces which are spaced apart in the longitudinal direction of the handle, the improvement comprising a one-piece U-shaped retainer clip loosely and movably positioned within said region between said opposed pair of stop surfaces, said clip including a bight positioned adjacent the bottom wall of said region as defined on said handle, said retainer clip having a pair of opposed spring arms defining therein aligned noncircular openings which slidably and nonrotatably pass therethrough said shank, and an annular adjusting nut positioned around said shank and having internal threads operatively engaged with the segmental threads on said shank, said internal threads having a segmental gap formed therein adapted to clear the segmental threads on said shank in one rotated position of the nut relative to the shank, said nut being positioned between the arms of said retainer clip and having an axial length such that the opposed spring arms bear yieldably and frictionally against the opposite axial end surfaces of the nut to retain the latter therebetween even when the clip and nut are separated from the wrench, said nut being captivated and retained solely due to its surrounding said shank and being resiliently axially confined between said opposed spring arms, and said retainer clip being captivated and retained solely due to the shank passing through the openings in the spring arms and the loose retention of the clip between the opposed pair of stop surfaces.

2. A wrench according to claim 1, including detent means integrally formed on and coacting between one of said arms and the adjacent end of said nut for holding the nut in a selected rotational position relative to the shank.

3. A wrench according to claim 2, wherein the detent means includes an axial projection and an axial recess integrally formed on and coacting between said nut and said one arm, said projection and recess being engageable for holding the nut in a rotative position wherein the gap in the threads thereof is in registry with the segmental threads on the shank.

4. A wrench according to claim 1, including detent means integrally associated with and coacting between one of said spring arms and the adjacent end of said nut for holding said nut in either one of two predetermined rotational positions relative to said shank, said nut when held in one said position being disposed so that the gap in the threads thereof is in registry with the segmental threads on the shank, said nut when held in said second position being disposed so that the threads thereof are engaged with the segmental threads on said shank.

5. A wrench according to claim 4, including indicia means associated with said nut and coacting with said retainer clip for indicating when the nut is rotated into the position wherein the detent means is engaged.

6. A wrench according to claim 1, wherein said U-shaped clip is formed from a thin sheetlike material and functions as a spring for retaining and confining the nut between the said opposed arms.

7. In a wrench having an adjustable outer jaw extending laterally from the end of a shank of noncircular cross section and having segmental threads formed along at least one side of the shank, the shank being slidably and nonrotatably received through an opening provided in a housing formed on the end of a handle having a fixed jaw opposed to said outer jaw, and stop means formed on the handle in longitudinally spaced relation to the inner side of said housing so as to define a sidewardly opening space therebetween, the improvement comprising an annular adjusting nut positioned around said shank between said housing and said stop means and having internal threads operatively engaged with the segmental threads on said shank, said internal threads having a segmental gap formed therein adapted to clear the segmental threads on said shank in one rotated position of the nut to permit axial slidable displacement of the shank, the axial dimension of said nut being less than the longitudinal spacing of said stop means from the inner side of said housing, and a retaining spring of U-shaped cross section loosely and movably positioned in said space for retaining the nut, said spring having a pair of opposed thin arms defining therethrough aligned noncircular openings which slidably and nonrotatably pass therethrough said shank, said spring also having a thin flat bight which is positioned within said space adjacent the side of said handle between the inner side of said housing and said stop means, the length of the bight of said spring and the axial length of said nut being such that said opposed arms bear yieldably and frictionally against the opposite axial ends of said nut for retaining the nut between said arms even though the arms are loosely and movably positioned within said space, and one end of said nut and the adjacent arm of said spring having coacting detent means thereon which are in registry when the threads in said nut are in registry with the segmental threads on said shank.

8. An adjustable nut assembly for converting a conventional rotationally adjustable pipe wrench into an axially-slidable adjustable pipe wrench, the conventional pipe wrench having an adjustable outer jaw extending laterally from the end of a shank of non-circular cross section and having segmental threads along at least one side of the shank, the shank being slidably and non-rotatably received through an opening provided in a housing formed on the end of a handle having a fixed jaw opposed to the outer jaw, and a stop formed on the handle in longitudinally spaced relationship from the inner side of the housing so as to define an open space therebetween, said adjustable nut assembly permitting the wrench to be converted so as to be adjusted by slidably displacing the shank axially through a nut without requiring any structural modification of the wrench handle or shank, said adjustable nut assembly comprising:

an annular adjusting nut having internal threads which are adapted to be operatively engaged with the segmental threads on the shank, said internal threads having a segmental gap formed therein and extending axially through the nut, said gap having a width sufficient to receive therein the segmental threads on the shank so that the latter can be slidably moved axially through the nut when the nut surrounds the shank and is rotatably positioned so that the segmental threads on the shank are in registry with the gap; a U-shaped retainer having a substantially flat planar bight and a pair of opposed cantilevered arms projecting approximately perpendicularly outwardly from the bight adjacent the opposite ends thereof, the U-shaped retainer being formed from a thin sheetlike material and functioning as a spring for yieldably retaining and confining the nut between the opposed arms thereof, said bight having a length similar to the axial length of said nut so that the bight can be positioned within said space adjacent a side surface of the handle, the ends of said arms remote from said bight being free so that the region between the free ends of said arms is totally open to provide free access to said nut, the opposed arms on said retainer having aligned openings formed therein, which openings are of elongated and approximately rectangular shape, said openings being adapted to permit the shank to slidably but nonrotatably pass therethrough so that the retainer is nonrotatably mountable on the shank and loosely longitudinally confined relative to the wrench handle due to being positioned between the inner side of the housing and the stop; the nut having an axial length closely corresponding to the axial spacing between the opposed arms so that the nut is held between the arms with the arms being maintained in yieldable and frictional engagement with the opposite axial ends of the nut; and detent means coacting between one of the arms and the adjacent axial end of the nut for holding the nut in either one of two selected rotational positions which are approximately 90° apart, said detent means including axially extending projections adapted for reception within axially directed recesses when the nut is in either one of said selected rotational positions, one of said projections and recesses being formed on one axial end of said nut, the other of said projections and recesses being associated with said one arm; said retainer and nut being loosely positionable within said space as associated with the handle of a conventional pipe wrench, with the shank of said pipe wrench being axially insertable through the aligned openings in the arms of said retainer and through the nut by virtue of the gap therein; said nut and retainer being held solely due to the surrounding of the shank by the nut and by the arms, and the loose confinement of the retainer adjacent the side surface of the handle between the inner side of the housing and the stop, without requiring any structural modification of the wrench handle or shank or the use of any additional components for securing the nut and retainer relative to the handle.

9. A nut assembly according to claim 8, wherein said one arm has a pair of said projections formed thereon and extending axially toward the opposed end surface of the nut, said projections being angularly spaced apart by an angle of approximately 90°, said nut having said pair of detent recesses formed in the adjacent axial end surface thereof for engagement with said projections, and indicia means associated with said nut for determining the rotational position of said relative to the shank, said indicia means including first indicia on the exterior periphery of said nut in axial alignment with said first recess and second indicia on the exterior periphery of said nut in axial alignment with the other recess to permit determination of the rotational position of the nut, said first and second indicia being different to distinguish said rotational positions.

* * * * *